US011499712B2

(12) United States Patent
Noeth et al.

(10) Patent No.: US 11,499,712 B2
(45) Date of Patent: Nov. 15, 2022

(54) GAS BURNER FOR COOKING APPLIANCES

(71) Applicant: Defendi Italy S.r.l., Camerano (IT)

(72) Inventors: Werner Noeth, Camerano (IT); Luca Breccia, Camerano (IT); Marco Sbaffi, Camerano (IT)

( * ) Notice: Subject to any disclaimer, the term of this patent is extended or adjusted under 35 U.S.C. 154(b) by 508 days.

(21) Appl. No.: 16/620,857

(22) PCT Filed: Jun. 11, 2018

(86) PCT No.: PCT/IB2018/054192

§ 371 (c)(1),
(2) Date: Dec. 9, 2019

(87) PCT Pub. No.: WO2018/229623

PCT Pub. Date: Dec. 20, 2018

(65) Prior Publication Data

US 2020/0191387 A1 Jun. 18, 2020

(30) Foreign Application Priority Data

Jun. 12, 2017 (IT) ..... 102017000064553

(51) Int. Cl.
*F23D 14/06* (2006.01)
*F23L 1/00* (2006.01)

(52) U.S. Cl.
CPC ..... *F23D 14/06* (2013.01); *F23L 1/00* (2013.01); *F23D 2900/00017* (2013.01); *F23D 2900/14003* (2013.01); *F23D 2900/14062* (2013.01)

(58) Field of Classification Search
CPC ..... F23L 1/00; F23D 14/06
(Continued)

(56) References Cited

U.S. PATENT DOCUMENTS 6,263,868 B1 * 7/2001 Koch ..... F23D 14/06 431/278
6,332,460 B1 * 12/2001 Paesani ..... F23D 14/06 126/39 R (Continued)

FOREIGN PATENT DOCUMENTS

EP 0964203 12/1999
EP 2071235 6/2009

(Continued)

*Primary Examiner* — Vivek K Shirsat
(74) *Attorney, Agent, or Firm* — Themis Law

(57) ABSTRACT

A gas burner for cooking appliances, having overlapping main flame and simmering flame rings, includes an injector holder assembly associated with a first and a second injector and positioned below a cooktop opening; and a head assembly associated at the top with the injector holder assembly and positioned above the cooktop opening, the head assembly having a first chamber communicating with the first injector and with doors for ejecting the gas and primary air mixture supplied to the main flame ring, and a second chamber communicating with the second injector and with a passageway for ejecting the gas and primary air mixture supplied to the simmering flame ring. The second chamber communicates with a through opening in the outer side walls of the head assembly to receive primary air from above the cooktop, and the head assembly completely seals the cooktop opening where the gas burner is to be installed.

20 Claims, 4 Drawing Sheets

Figure 1:
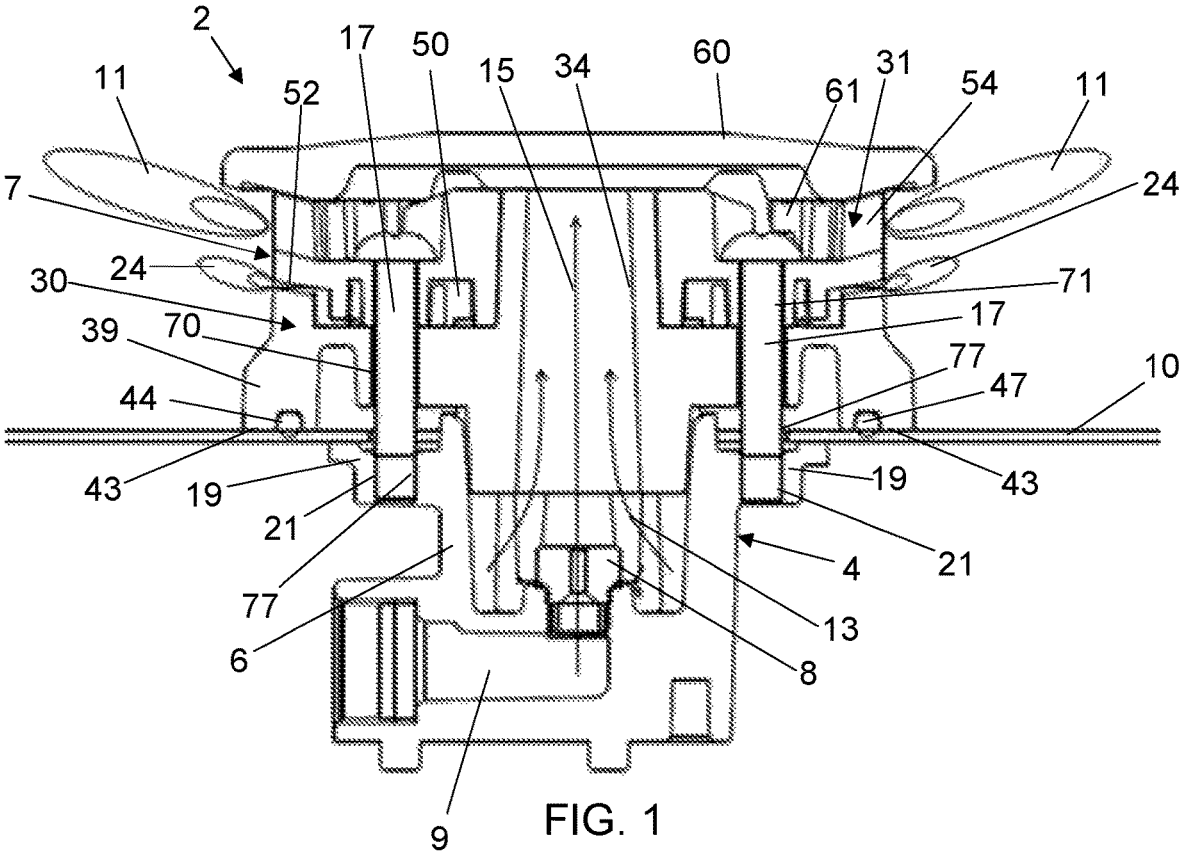

(58) Field of Classification Search
USPC ..... 126/39 E
See application file for complete search history.

(56) References Cited

U.S. PATENT DOCUMENTS

| | | | | |
|---|---|---|---|---|
| 7,281,009 | B2 | 10/2007 | Adas et al. | |
| 7,901,205 | B2 * | 3/2011 | Trochou | F23D 14/64 431/278 |
| 10,190,778 | B2 * | 1/2019 | Emiliani | F23D 14/06 |
| 2013/0306055 | A1 * | 11/2013 | Cadima | F24C 3/085 126/39 E |

FOREIGN PATENT DOCUMENTS

| | | |
|---|---|---|
| WO | 2004102072 | 11/2004 |
| WO | 2014049421 | 4/2014 |

* cited by examiner

GAS BURNER FOR COOKING APPLIANCES

The present invention relates to a gas burner for cooking appliances.

Gas burners are known with one or more flame rings and in particular, gas burners are known with a main flame ring which is arranged at a given level in the burner, and a ring of flames called simmering flames, which is arranged at a different level.

While the main flame ring is used to ensure the supply of the power required for high temperature cooking, the simmering flame ring is used to ensure a minimum power supply to be used for low temperature cooking; for this reason, the lower the temperature that the simmering flame ring is capable of ensuring, the better the performance of the burner.

U.S. Pat. No. 6,263,868 already describes a gas burner with two flame rings arranged at two different levels and namely, with a main flame ring arranged at a higher level and with a simmering flame ring arranged at a lower level. In particular, the simmering flame ring is arranged on the circumferential wall of the burner and is sensitive to the air movements which inevitably occur over the cooktop. Moreover, in order to ensure the hold, the burner cap assembly of such a solution is directly in contact with the upper surface of the cooktop and thus the primary air which supplies both the flame rings is to necessarily be sucked from below the cooktop. In greater detail, the fact that the primary air that supplies the simmering flame ring comes from below the cooktop results in such a ring, which is already supplied with a minimum gas flow and is sensitive to air movements over the cooktop, is also sensitive to the streaming phenomenon, and to the vacuum involving the flow of primary air following the opening of a door arranged below the cooktop and which may result in the turning off of the simmering flames.

U.S. Pat. No. 7,291,009 describes a gas burner with two flame rings arranged at two different levels and namely, with a main flame ring arranged at a higher level and with a simmering flame ring arranged at a lower level. In particular, such a burner comprises an upper cap burner in which there are made openings for the main flames and a lower cap burner in which there are made the openings for the simmering flames and below the latter, there are made the doors for introducing the primary air sucked from above the cooktop. The upper cap burner is closed at the top by a cover and is resting on the lower cap burner, which in turn is simply resting on the injector holder assembly.

In greater detail, the injector holder assembly, which is positioned at the through opening made in the cooktop, has a lower frame on which there are fastened the injectors and a cup-shaped body provided with an outer flange which is resting from above on the edges which surround the opening defined in the cooktop.

In essence, the primary air for the simmering flame ring in such a burner comes from above the cooktop and is sucked through doors which are defined on the walls of the lower cap burner, below the openings provided for ejecting the simmering flames. In greater detail, the primary air for the simmering flames enters the chamber which is defined in the cup-shaped body on which bottom there is fastened the gas injector for the simmering flames, through these doors defined on the side walls of the lower cap burner.

However, the injector holder assembly of this burner is not perfectly isolated from the area positioned above the cooktop itself at the installation opening on the cooktop, and this induces drawbacks associated with the fact that the cooking liquids may enter the injector holder assembly, with the risk of obstructing the injectors themselves.

EP2071235 describes a gas burner with two flame rings arranged at two different levels and namely, with a main flame ring arranged at a lower level and with a simmering flame ring arranged at an upper level.

In particular, this burner has:

a cup-shaped injector holder body, in which a first injector is associated with the bottom of said bottom, while a second injector is accommodated in a cylindrical chamber provided in the same injector holder body, a cap burner which is resting on the injector holder body, a separator element which is resting at the top on the cap burner and which defines, with the latter, a chamber for supplying the main flame ring, a cover which is resting on the separator element and which defines, with the latter, a chamber for supplying the simmering flame ring, The primary air for the first injector (i.e. that on the bottom of the injector holder body and which supplies the gas for the main flame ring) enters the injector holder body through the space which is defined above the cooktop, between the latter and the cap burner. The primary air for the second injector (i.e. that provided in the cylindrical chamber of the injector holder body and which supplies the gas for the simmering flame ring) instead is taken from above the cooktop and enters the injector holder body through an opening defined on the wall of the cylindrical chamber of the injector holder body.

Also in this solution, given that there is to be a space—defined between the cap burner and the cooktop—for introducing the air from above the cooktop itself, the result is the injector holder body of this burner is not perfectly isolated from the area positioned above the cooktop itself and this induces drawbacks associated with the fact that the cooking liquids may enter the injector holder assembly, with the risk of obstructing the injectors themselves.

EP0964203 describes a gas burner with a portion of head and with a body which, by means of elastic fastening means, is elastically supported inside by a hole made in the cooktop. In particular, the elastic fastening means consist of a cup-shaped spring and of a circular flange, which are positioned so as to act on the lower and upper surface respectively, of the cooktop. Moreover, a sealant is interposed between the cup-shaped spring and the flange to ensure a suitable closure of the hole of the cooktop also in case of movements of the lower body of the burner. This type of burner does not have two flame rings and in particular, it does not have a simmering flame ring and thus does not deal with the problems disclosed above with reference to the other burners of the known art.

WO2014/049421 describes a gas burner with two flame rings in which there is provided a forced air generator at a first injector. Moreover, the primary air for the second injector is taken from above the cooktop through a circumferential passageway defined between the injector holder body and the cap burner.

It is the object of the invention to suggest a gas burner for cooking appliances provided with a simmering flame ring but without the drawbacks which may be recognized in known gas burners of this type.

It is another object of the invention to suggest a gas burner in which the simmering flame ring may be supplied with a minimum gas flow, lower than that at which the external conditions in traditional burners may result in the flames themselves turning off.

It is another object of the invention to suggest a gas burner which is insensitive both to the streaming phenomenon, and to the vacuum involving the flow of primary air following the opening of a door arranged below the cooktop.

It is another object of the invention to suggest a gas burner with simmering flame ring in which the injectors are perfectly isolated from the upper area of the cooktop at the opening of the cooktop defined for the installation of the burner itself.

It is another object of the invention to suggest a gas burner having a rather limited vertical volume and therefore capable of being installed also in cooktops having minimum thickness.

It is another object of the invention to suggest a gas burner which has an alternative and/or improved construction and functional characterization with respect to the traditional ones.

It is another object of the invention to provide a gas burner which may be obtained in a simple, quick manner and with low costs.

It is another object of the invention to suggest a gas burner with a limited number of parts and therefore affordable, having safe operation and installable both on cooktops and directly in gas cookers.

It is another object of the invention to suggest an installation of a burner on a cooktop which simultaneously has a simmering flame ring, is insensitive to the streaming phenomenon, ensures a perfect isolation of the upper area of the cooktop and may be obtained in a simple, quick manner and with low costs.

All these objects, both individually and in any combination thereof, and others which will become apparent from the description below, are achieved according to the invention by a gas burner for cooking appliances with the features of claim 1, and also with an installation comprising the features of claim 46.

Figure 2:
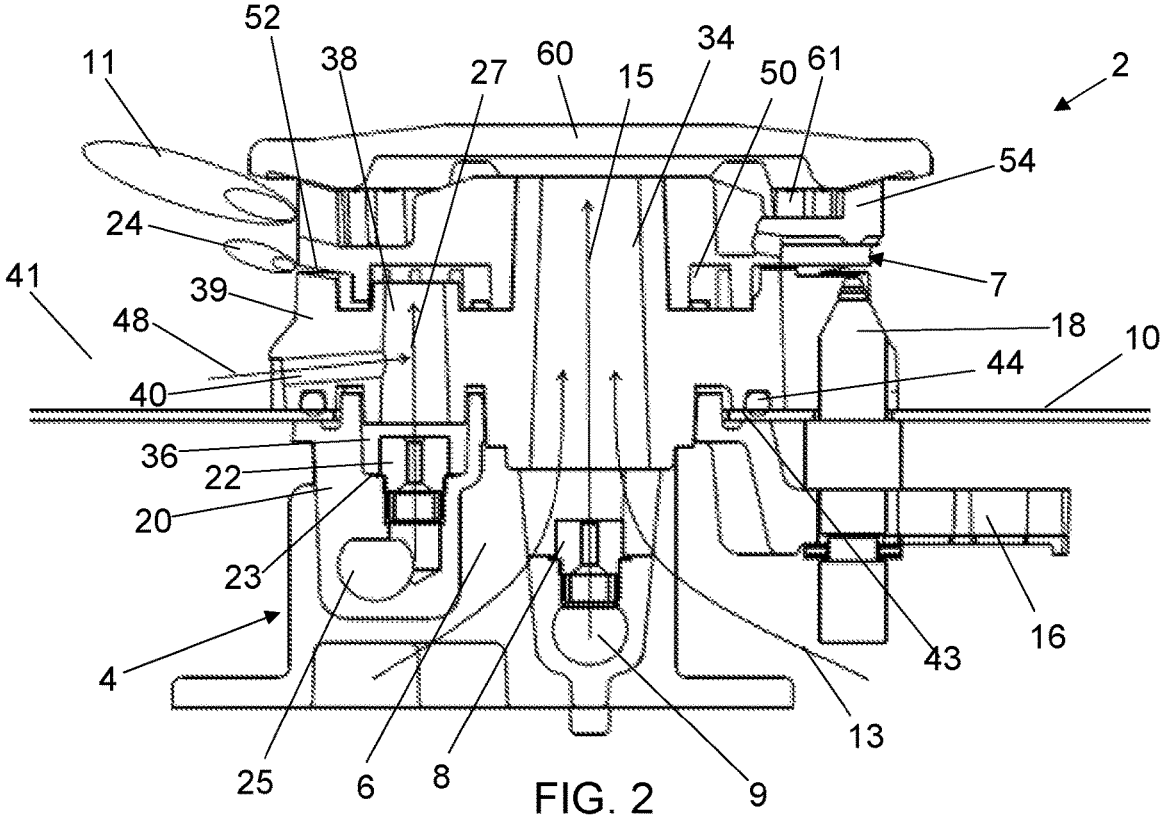
Figure 3:
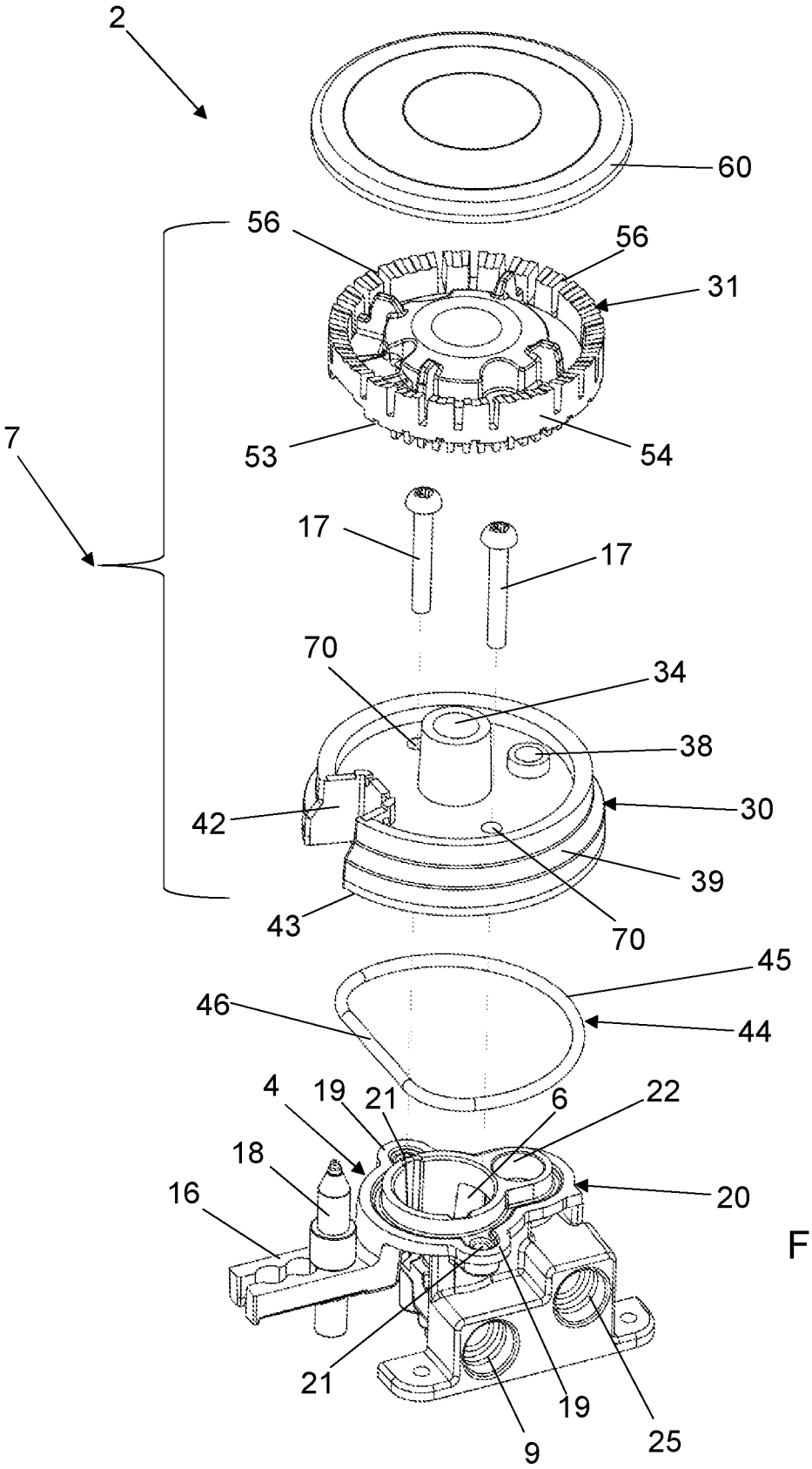
Figure 4:
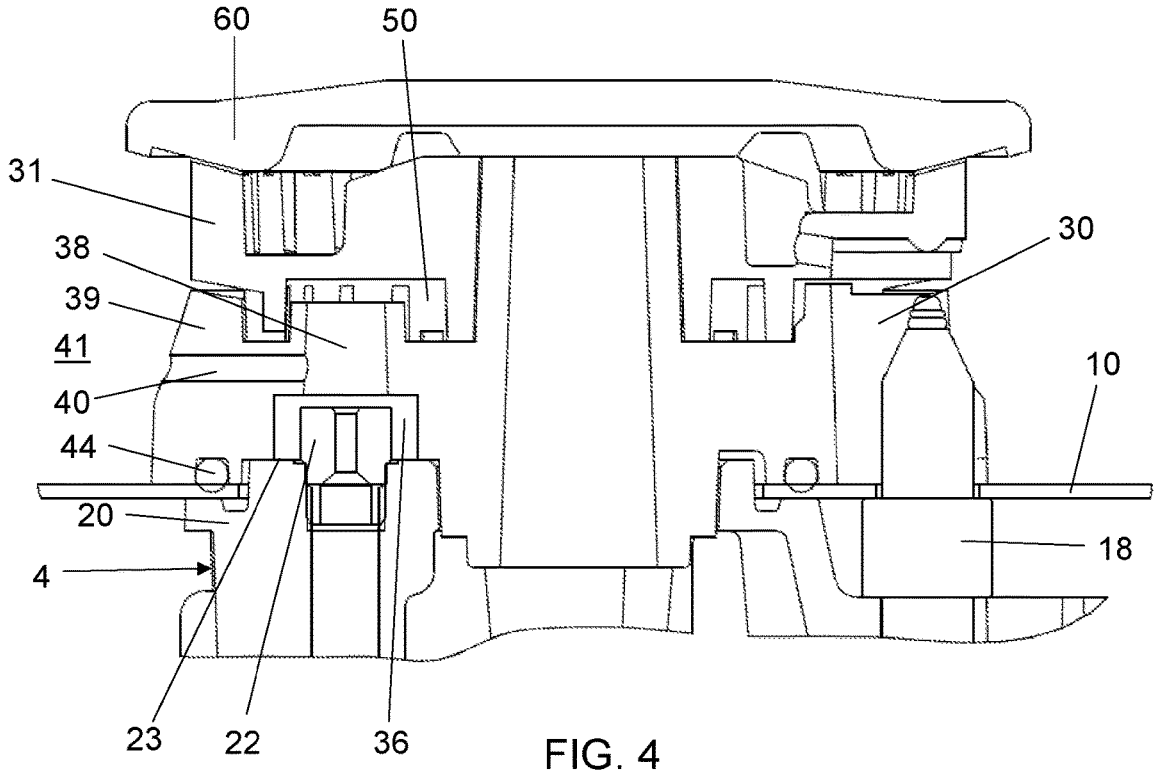
Figure 5:
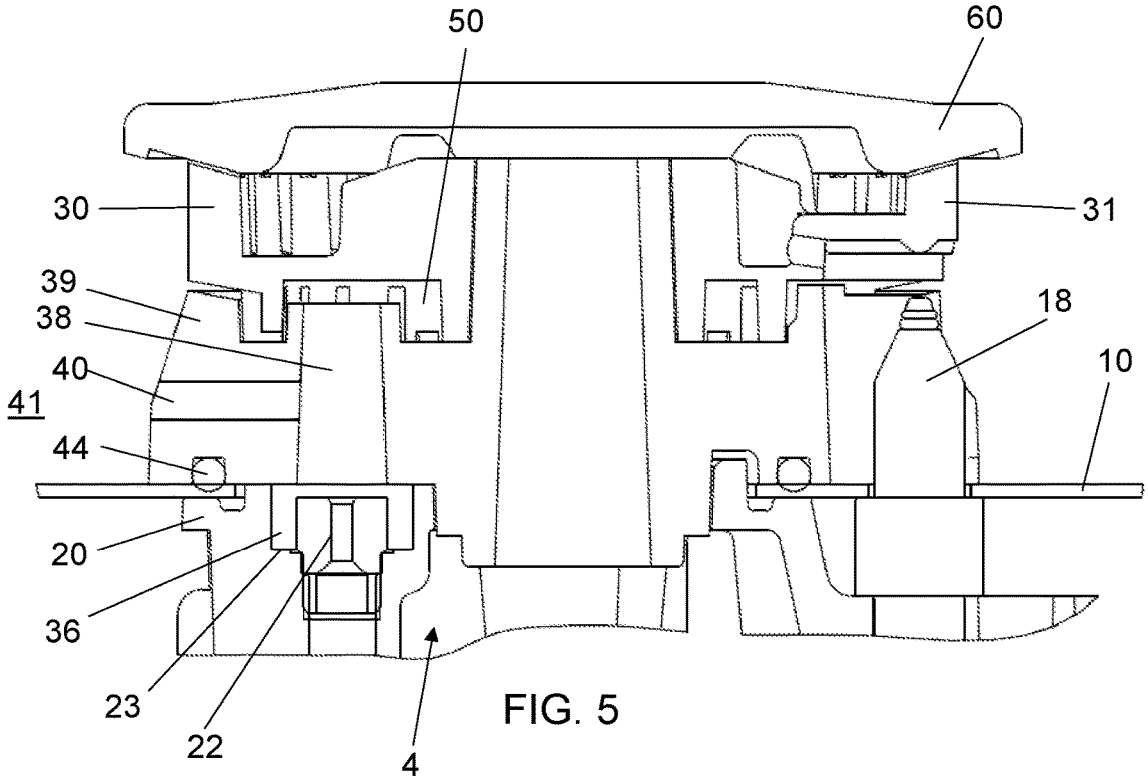
Figure 6:
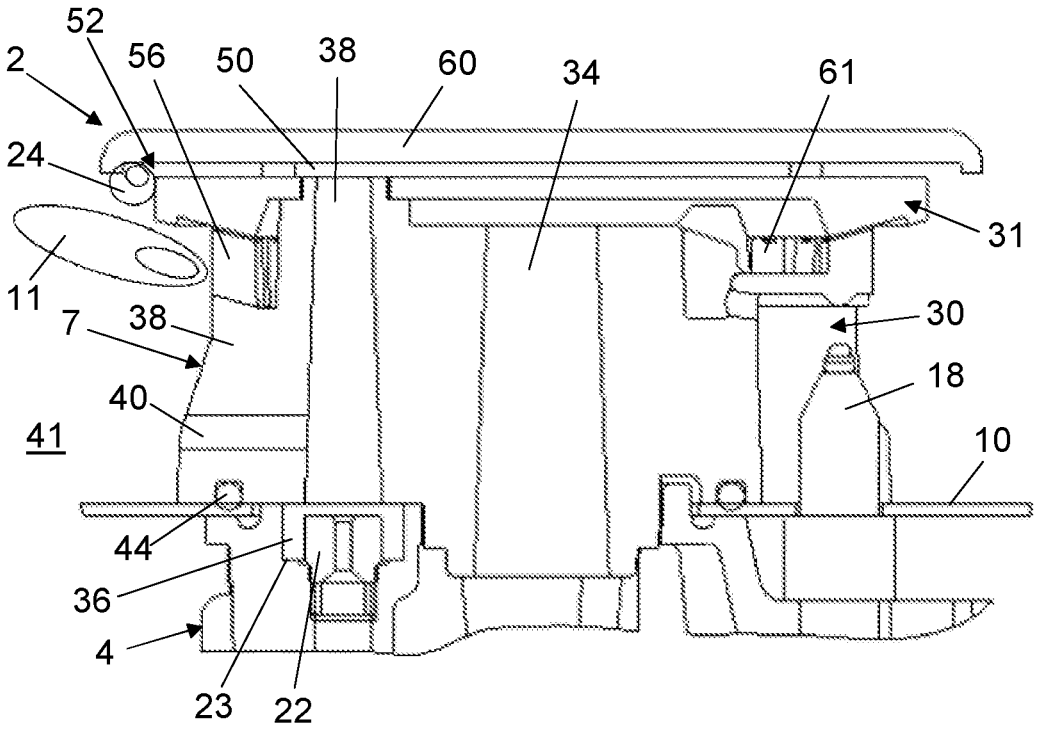
Figure 7:
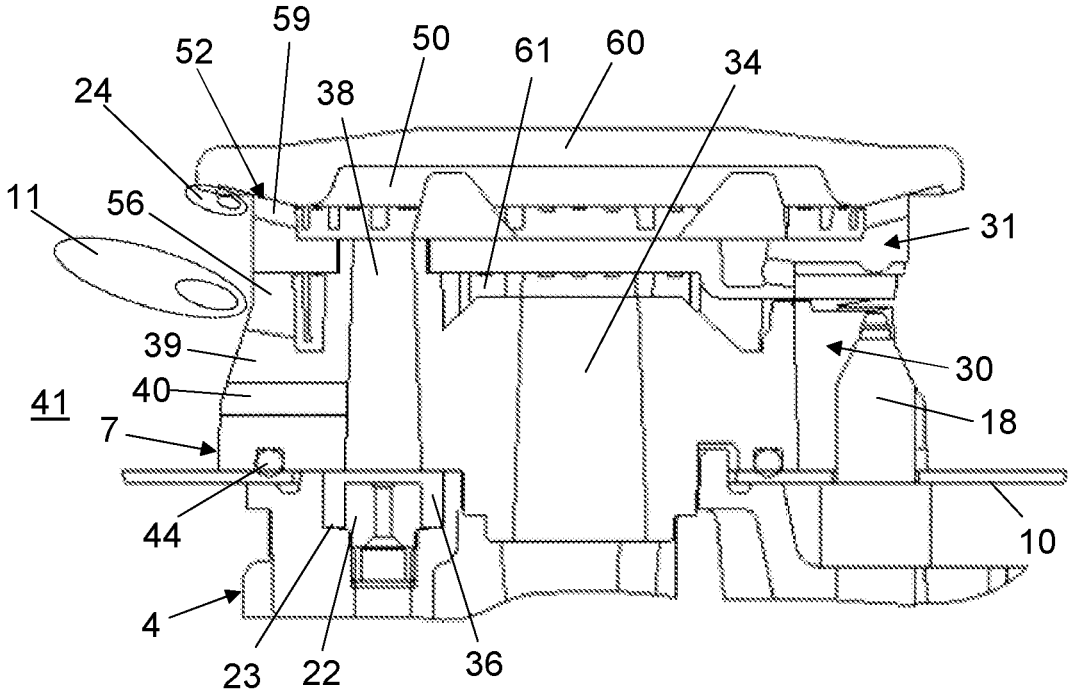

The present invention is hereinbelow further clarified in certain preferred embodiments thereof, which are described by mere way of non-limiting example, with reference to the accompanying drawings, in which:

FIG. 1 shows a vertical section of a burner according to the invention, conducted along a first vertical section passing through the injector alone from which the gas for the main flames is ejected, FIG. 2 shows it in a different vertical section conducted along a plane rotated by 90° with respect to that in FIG. 1, FIG. 3 shows an exploded perspective view thereof, FIG. 4 shows a perspective view of a second embodiment of the burner according to the invention, cross-sectioned along a vertical plane passing through the spark igniter, FIG. 5 shows a vertical section of a third embodiment thereof, conducted along a plane passing through the spark igniter, FIG. 6 shows a vertical section of a fourth embodiment thereof, conducted along a plane passing through the spark igniter, FIG. 7 shows a vertical section of a fifth embodiment thereof, conducted along a plane passing through the spark igniter.

As shown in the drawings, burner 2 according to the invention comprises an injector holder assembly 4 positioned below cooktop 10, at an installation opening made in the latter, and a head assembly, indicated as a whole with 7, which is positioned above cooktop 10.

The injector holder assembly 4 comprises a cup-shaped support 6 inside of which a first cavity is defined. Moreover, a first injector 8, which is associated with a first gas inlet 9 and is intended to supply a main flame ring 11, is positioned preferably on the bottom of such a cup-shaped support 6. In particular, gas 15 for the main flames 11 is ejected from the first injector 8.

Advantageously, the cup-shaped support 6 is partly open, preferably laterally and/or on the bottom to allow the introduction of primary air 13, which is therefore sucked from below cooktop 10, for the supply of the main flame ring 11.

Advantageously, a support arm 16 of a spark igniter 18 then radially extends from the cup-shaped support 6, below the sheet of cooktop 10.

Conveniently, the side wall of the cup-shaped support 6 is also provided with two flanges 19 protruding outwards to adhere to cooktop 10 from below, and is provided with first through holes 21 for the crossing of fastening screws 17, as described in greater detail below.

The injector holder assembly 4 also comprises a base 23, which preferably is substantially horizontal, on which there is mounted a second injector 22, which is associated with a second inlet 25 for the gas which is intended to supply a simmering flame ring 24. Conveniently, it is understood that the simmering flame ring 24 may be in the form of a blade or separate flames.

Conveniently, a side portion 20 comprising the substantially horizontal base 23 on which the second injector 22 is mounted, is associated with the cup-shaped support 6. In particular, gas 27 for the simmering flames 24 is ejected from the second injector 22.

Preferably, the simmering flames 24 in the embodiments depicted in FIGS. 1 to 5 are defined below the main flame ring 11, however it is understood that the simmering flames 24 in another embodiment of the invention (see FIGS. 6 and 7) may be defined above the main flame ring 11.

Advantageously, when the simmering flames 24 are positioned below the main flame ring 11 (see FIGS. 1 to 5), the simmering flames 24 are more spaced apart from the bottom of the pot to be heated, thus allowing the heating effect of the simmering flames to be decreased on the pot in the condition in which these are the only flames ignited (i.e., when the main flames 11 are turned off). In essence, the possible heating effect of the simmering flames thereby is decreased as much as possible, which main function is not so much to heat the pot, rather that of keeping it at a given temperature.

Conveniently, given the minimum gas flow for the simmering flames 24, the outflow hole of this second injector 22 is significantly smaller than the outflow hole provided in the first injector 8.

Preferably, the two injectors 8 and 22 are supplied through a single valve (not depicted), which according to the position of the control knob thereof, provides to supply the gas to both injectors 8 and 22 or to the second injector 22 alone.

The head assembly 7 of the burner, which advantageously is formed by a lower body 30, an upper body 31 and preferably also a cover 60, is associated at the top with the injector holder assembly 4.

The head assembly 7 comprises therein:

a first chamber 61 which is in communication with the first injector 8 and with a series of doors 56 for ejecting the mixture of gas 15 and primary air 13 which supplies the main flame ring (11), and a second chamber 50 which is in communication with the second injector 22 and with at least one passageway 52 for ejecting the mixture of gas 27 and primary air 48 which supplies the simmering flame ring 24.

Preferably, as shown from the embodiments herein described and depicted in FIGS. 1 to 5, the second chamber 50 is arranged at the bottom with respect to the first chamber 61, however it is understood that the second chamber 50 in other embodiments of the invention (see FIGS. 6 and 7) may be positioned at the top with respect to the first chamber 61.

In particular, the lower body 30, which preferably has a substantially circular shape, conveniently is positioned on the injector holder assembly 4. Conveniently, it has a first upwards protruding truncated conical-shaped axial duct 34, which is coaxial to the first injector 8 and has the lower opening facing thereto. Preferably, the lower stretch of the axial duct 34 is at least partly inserted (i.e., it crosses) inside the chamber defined in the cup-shaped support 6 of the injector holder assembly 4.

Moreover, there conveniently is defined, inside the lower body 30, a second axial duct 38, preferably cylindrical or truncated conical-shaped, which faces the second injector 22 at the bottom and opens at the upper surface of the lower body 30.

Advantageously, a cavity 36 is defined in the side portion 20 of the injector holder assembly 4, in which cavity there is accommodated the second injector 22 which faces the second axial duct 38 at the top.

Advantageously, as shown in the embodiments in FIGS. 2 and 5, the second injector 22 with the corresponding base 23 on which it is mounted and with the corresponding housing cavity 36, are defined inside the injector holder assembly 4 so as to be below or substantially flush with the sheet of cooktop 10.

Alternatively, as in the embodiment in FIG. 4, the second injector 22 with the corresponding base 23 on which it is mounted, are defined in the injector holder assembly 4 so that once the latter is installed in cooktop 10, injector 22 and/or base 23 are above the sheet of cooktop 10. In this case, the housing cavity 36 for the second injector 22 is made in the lower body 30 of the head assembly 7.

The second chamber 50 is in communication with at least one through opening 40, which is made in (i.e. through) the outer side walls 39 of said head assembly 7, for introducing primary air 48 from above said cooktop 10 for the second injector 22, i.e. for the supply of the simmering flames 24.

Advantageously, there is made, at the outer side wall 39 of the head assembly 7, a through opening 40, preferably a duct which is substantially horizontal (see FIGS. 4 and 5) or slightly inclined with respect to the horizontal (see FIG. 2), which puts space 41 about the burner and above cooktop 10 directly into communication with the second axial duct 38 made in the lower body 30.

Conveniently, the primary air 48 for the second injector 22, i.e. for supplying the simmering flames 24, in essence is sucked through/taken from above cooktop 10 through the through opening 40. Conveniently, by taking the primary air 48 from above cooktop 10, the simmering flames 24 do not suffer from the streaming, namely they do not suffer from the vacuum involving the flow of primary air following the opening of a door arranged below cooktop 10.

Conveniently, the lower body 30 comprises, at the outer side part 39 thereof, a recess 42 for the spark igniter 18.

The head assembly 7 is configured to completely seal the opening from above, which is made in cooktop 10 and wherein said burner 2 is intended to be installed. Conveniently, to this end, the lower body 30 is shaped and sized so that when it is associated with the injector holder assembly 4, the outer edges of the lower base 43 thereof are completely in contact with the upper surface of the sheet of cooktop 10.

Advantageously, a sealing gasket 44 is associated with the lower surface of the lower body 30. Preferably, such a gasket 44 comprises a shaped ring made of compressible material. In greater detail, gasket 44 is defined by a broad arc of circumference 45 and by the corresponding underlying cord 46.

Preferably, gasket 44 is accommodated in a groove 47 defined at the outer profile of the lower base 43 of the lower body 30.

Advantageously, the upper element 31 is then associated at the top with the lower body 30 so that there is defined a passageway 52 for ejecting the simmering flames 24 between the lower edge of the upper element and the upper edge of the lower body 30. Conveniently, it is provided for this passageway to consist of a narrow continuous slit or of a discontinuous narrow slit obtained due to the presence of a plurality of doors 53 made on the outer lower edge of the upper body 31 (see FIG. 3) and/or on the outer upper edge of the lower body 30.

Conveniently, the upper body 31 has lower appendixes which rest on the upper base of the lower body 30 so as to keep the outer lower edge of the first slightly raised with respect to the outer upper edge of the second.

Advantageously, the upper surface of the lower body 30 and the lower surface of the upper body 31 delimit therebetween a chamber 50 for mixing/distributing gas 27 and primary air 48 which supply the simmering flames 24. In particular, this chamber 50 is in communication with the passageways 52 for ejecting the simmering flames 24 and also in communication with the upper end of the second axial duct 38 which faces the second injector 22 and which receives, through the suction opening 40, the primary air 48 from above cooktop 10. Preferably, the mixing/distribution chamber 50 defines a radial-effect Venturi.

Conveniently, the upper body 31 is involved in the middle by an opening in which the upper stretch of the first axial duct 34 is inserted and has a peripheral side wall 54 in which there are made, at the top, a plurality of doors 56 for ejecting the mixture of gas 15 and primary air 13, which supply the main flame ring 11.

Preferably, cover 60 is resting on the upper edge of the peripheral side wall 54 of the upper body 31, which cover delimits—with the underlying upper body 31—a mixing/distribution chamber 61 which preferably has a radial Venturi effect and globally has a circular shape.

Advantageously, this cover 60, which at the top delimits chamber 61 for supplying the main flame ring 11, has the edge protruding with respect to the underlying peripheral side wall 54 of the upper body 31 and, with the upper edge of the latter, defines the passageways for ejecting the main flame ring 11.

Advantageously, there are also obtained, in the lower body 30 and in the upper body 31, second 70 and third through holes 71 respectively, which are vertically aligned with one another. Conveniently, the second through holes 70 made in the lower body 30 and the third through holes 71 made in the upper body 31 are crossed by fastening screws 17 which after crossing corresponding fourth holes 77 made in cooktop 10, are locked, at the ends thereof, in the first through holes 21 made in the injector holder assembly 4 (see FIG. 1).

Preferably, all the aforesaid through holes 21, 70 and 71 and only the first 21 and/or second through holes 70 are threaded internally to allow the engagement with the corresponding threaded portion of the fastening screws 17.

Preferably, as depicted in the drawings, there are two through holes 21, 70 and 71 with the corresponding fastening screws 17, and they are made in diametrically opposite mutual position.

Conveniently therefore, the lower body 30 and the upper body 31 of the head assembly 7 of the burner are stably restrained to each other and to the injector holder assembly 4 by means of fastening screws 17. Advantageously, this allows avoiding undesired and/or involuntary movements at cooktop 10 from inducing the uncoupling of the head assembly 7 from the injector holder body 4.

Furthermore, the sheet of cooktop 10 thereby is sandwiched between the head assembly 7 and the injector holder assembly 4. Moreover, the fact that the lower base 43 of the lower body 30 is completely in contact with the upper surface of cooktop 10, and also the advantageous presence of the sealing gasket 44 at such a contact area, allows space 41 above cooktop 10 to be sealed hermetically from the injector holder assembly 4, while allowing the suction from above cooktop 10 of the primary air 48 for the simmering flames 24.

The operation of burner 2 according to the invention is as follows.

The control knob of the gas supply valve is operated and brought to the position (generally at 90°) of maximum gas supply; this is sent to both injectors 8 and 22.

Since the cup-shaped support 6 of the injector holder assembly 4 is partly open (preferably laterally and/or on the bottom), gas 15 ejected from the first injector 8 drags a flow of primary air 13 from below cooktop 10 into duct 34 according to the path indicated by the arrow in FIG. 1. The flows of gas 15 and of primary air 13 thus reach the upper chamber 61, where they mix due to the Venturi effect and the mixture thereof supplies the main flame ring 11 through the doors 56.

Simultaneously, gas 27 which is ejected from the second injector 22—in much smaller quantity than that ejected from injector 8—sucks primary air 48 from above cooktop 10 and, through the through opening 40 made in the outer side walls 39 of the lower body 30, it drags it into the second axial duct 38, which faces the second injector 22, according to the path indicated by arrow 48 in FIG. 2. The flows of gas 27 and primary air 48 therefore completely cross the second axial duct 38, reach the lower chamber 50 where they form a mixture which supplies the simmering flames 24, in the form of a blade or separate flames, according to the variants of the burner, and in both cases preferably join with the main flames 11.

Conveniently, the circuit which supplies the main flames 11 with gas 15 and primary air 13 is separate from and is not communicating with the circuit which supplies the simmering flames 24 with gas 27 and primary air 48.

If the user further rotates the gas supply valve control knob from the maximum supply position (which preferably is at about 90°), the main flames 11 decrease and are cancelled when the control knob is completely rotated. Therefore, only the simmering flames 24 remain ignited in this position, which on the one hand are protected from the protruding edge of cover 60 and thus are stable, and on the other, are not sensitive to the streaming effect since they are supplied by primary air 48 taken from above cooktop 10.

Advantageously, this allows the simmering flames 24 to be brought to a particularly low value, thus significantly reducing the power of the burner while ensuring a satisfactory flame stability in all conditions and at the same time guaranteeing a perfect hold of the coupling between the head assembly 7 and the injector holder assembly 4 thereof at the opening of cooktop 10 in which burner 2 is installed.

The embodiments shown in FIGS. 4 and 5 substantially have all the features (both essential and preferential) referred to above for the description of the embodiment illustrated in FIGS. 1 to 3, in particular related to the fact that the simmering flames 24 are supplied by primary air taken from above cooktop 10 by means of a through opening 40 which connects the outer space 41 about burner 2 directly with the second axial duct 38. In other words, the end of the duct which defines the through opening 40 directly ends in the second vertical axial duct 38. Advantageously, the duct which defines the through opening 40 for the suction of the primary air 48 for the simmering flames 24 substantially is horizontal in the embodiments shown in FIGS. 4 and 5.

Moreover, and in greater detail, although it always faces the second axial duct 38, cavity 36 which accommodates (and in which there is inserted) the second injector 22 is made in the lower area of the lower body 30 in the embodiment in FIG. 4. Conveniently, it is understood that the second injector 22, which is always mounted on the horizontal base 23 of the injector holder assembly 4, protrudes at the top with respect to the latter in such an embodiment.

The embodiments shown in FIGS. 6 and 7 substantially have all the features (both essential and preferential) referred to above for the description of the embodiment illustrated in FIGS. 1 to 3, in particular related to the fact that the simmering flames 24 are supplied by primary air taken from above cooktop 10 by means of a through opening 40 which connects the outer space 41 about burner 2 directly with the second axial duct 38. In other words, the end of the duct which defines the through opening 40 directly ends in the second vertical axial duct 38. Advantageously, the duct which defines the through opening 40 for the suction of the primary air 48 for the simmering flames 24 substantially is horizontal in the embodiments shown in FIGS. 6 and 7.

Furthermore in greater detail, the simmering flame ring 24 in the embodiments in FIGS. 6 and 7 is positioned at the top with respect to the main flame ring 11 and conveniently, also the second chamber 50—which is in communication with the second injector 22 and with at least one passageway 52 for ejecting the mixture of gas 27 and primary air 48 which supplies the simmering flame ring 24—is arranged at the top with respect to the first chamber 61, which is in communication with the first injector 8 (not depicted in FIGS. 6 and 7) and is provided with doors 56 for ejecting the mixture of gas 15 and primary air 13 which supplies the main flame ring 11.

Advantageously, the simmering flame ring 24 in the embodiment in FIG. 6 is in the form of a blade, i.e. it is a single simmering flame of annular and continuous type which comes out from passageway 52, which conveniently consists of the thin continuous slit defined between the upper edge of the upper body 31 of the head assembly 7 and cover 60.

Advantageously, the simmering flame ring 24 in the embodiment in FIG. 7 is in the shape of a plurality of flames, which are separate from one another and which come out from the passageways 52 which conveniently are defined by a plurality of slots 59 made on the outer upper edge of the upper body 31 of the head assembly 7.

Conveniently, it is understood that the present invention also relates to an installation which comprises a cooktop in which there is installed/applied a burner as described above, both in the essential and in the preferential features thereof.

The burner, and the corresponding installation, according to the present invention is more advantageous than all the other known solutions because it is the only one which allows the space above the cooktop to be hermetically isolated from the injector holder assembly, while allowing the suction of the primary air for the simmering flames from above the cooktop, thus making the simmering flames not sensitive to the streaming phenomenon.

The invention claimed is:

1. A gas burner for cooking appliances, having a main flame ring and a simmering flame ring vertically overlapping each other, comprising:

an injector holder assembly associated with a first injector and a second injector, the injector holder assembly being adapted to be positioned below a cooktop at an opening made therein; and a head assembly of the gas burner associated at a top with the injector holder assembly and adapted to be positioned above the cooktop at the opening made therein, the head assembly comprising therein a first chamber in communication with the first injector and with a plurality of doors for ejecting a mixture of gas and primary air supplied to the main flame ring, and a second chamber in communication with the second injector and with a passageway for ejecting the mixture of gas and primary air supplied to the simmering flame ring, wherein:

the second chamber is in communication with a through opening defined in outer side walls of the head assembly for introducing the primary air from above the cooktop, the head assembly is configured to completely seal from above the opening in the cooktop where the gas burner is intended to be installed, the second chamber is in communication with the second injector via a vertical axial duct made in the head assembly and facing the second injector, and the through opening for introducing the primary air from above the cooktop comprises at least one duct which crosses the outer side walls and directly ends in the vertical axial duct.

2. The gas burner according to claim 1, wherein the second chamber is disposed at a bottom of the first chamber.

3. The gas burner according to claim 1, wherein the second chamber is disposed at the top of the first chamber.

4. The gas burner according to claim 1, wherein a base of the head assembly is configured and sized to be completely in contact with an upper surface of the cooktop about the opening where the gas burner is to be installed, thus insulating the injector holder assembly from a space defined above the cooktop and about the burner.

5. The burner according to claim 1, further comprising a sealing gasket at a base of the head assembly, the sealing gasket being provided to externally surround the opening in the cooktop.

6. The burner according to claim 5, wherein the sealing gasket is accommodated in a groove defined at an outer profile of a base of the head assembly.

7. The gas burner according to claim 1, wherein the primary air supplying the main flame ring originates from below the cooktop.

8. The gas burner according to claim 1, wherein:

the first chamber is defined between an upper body of the head assembly and an upper cover of the gas burner, and the second chamber is defined between the upper body and a lower body of the head assembly.

9. The gas burner according to claim 8, wherein the passageway for ejecting the mixture of gas and primary air supplying the simmering flame ring is defined between the upper body and the lower body of the head assembly.

10. The gas burner according to claim 1, wherein the first chamber is in communication with the first injector via a second vertical axial duct made in the head assembly and facing the first injector.

11. The gas burner according to claim 1, wherein the first chamber defines a first radial-effect Venturi and the second chamber defines a second radial-effect Venturi.

12. The gas burner according to claim 1, wherein the through opening for introducing the primary air from above the cooktop comprises the at least one duct in horizontal or inclined position with respect to a horizontal line, the at least one duct crossing the outer side walls of the head assembly from one side to the other.

13. The gas burner according to claim 1, wherein the second chamber is in communication with the second injector via a cavity and the vertical axial duct.

14. The gas burner according to claim 13, wherein the cavity is completely or at least partly positioned above a sheet of the cooktop.

15. The gas burner according to claim 13, wherein the cavity is completely positioned below a sheet of the cooktop.

16. The gas burner according to claim 1, wherein a first circuit supplying the main flame ring with the gas and the primary air is separate from and not communicating with a second circuit supplying the simmering flame ring with the gas and the primary air.

17. The gas burner according to claim 1, further comprising one or more fasteners crossing the head assembly and inserted in the injector holder assembly so that a sheet of the cooktop is sandwiched between the head assembly and the injector holder assembly.

18. The gas burner according to claim 1, further comprising one or more fasteners crossing the head assembly to firmly restrain the head assembly to the injector holder assembly and to the cooktop.

19. The gas burner according to claim 18, wherein the one or more fasteners comprise fastening screws which cross corresponding through holes made in the head assembly and the injector holder assembly.

20. The gas burner according to claim 18, wherein the head assembly comprises an upper body and a lower body that are restrained together by the one or more fasteners that restrain the injector holder assembly to the cooktop.

* * * * *